United States Patent [19]

Nace

[11] 4,147,617

[45] Apr. 3, 1979

[54] PROCESSING HYDROCARBON FEED OF HIGH CARBON RESIDUE AND HIGH METALS CONTENT

[75] Inventor: Donald M. Nace, Woodbury, N.J.

[73] Assignee: Mobil Oil Corporation, New York, N.Y.

[21] Appl. No.: 894,205

[22] Filed: Apr. 6, 1978

[51] Int. Cl.[2] ..... B01J 8/24; C10G 11/04

[52] U.S. Cl. ..... 208/74; 208/73; 208/95; 208/120; 208/251 R

[58] Field of Search ..... 208/76, 120, 73–74, 208/95, 251 R

[56] References Cited

U.S. PATENT DOCUMENTS

| | | | |
|---|---|---|---|
| 3,182,011 | 5/1965 | Friedman | 208/74 X |
| 3,617,497 | 11/1971 | Bryson et al. | 208/80 |
| 3,679,576 | 7/1972 | McDonald | 208/74 |
| 3,821,103 | 6/1974 | Owen et al. | 208/72 |
| 3,847,793 | 11/1974 | Schwartz et al. | 208/70 |
| 3,886,060 | 5/1975 | Owen | 208/120 |
| 3,891,540 | 6/1975 | Demmel et al. | 208/77 |
| 3,894,933 | 7/1975 | Owen et al. | 208/74 X |
| 3,894,934 | 7/1975 | Owen et al. | 208/78 |
| 3,896,024 | 7/1975 | Nace | 208/74 |
| 3,926,778 | 12/1975 | Owen et al. | 208/74 |

*Primary Examiner*—Delbert E. Gantz
*Assistant Examiner*—G. E. Schmitkons
*Attorney, Agent, or Firm*—Charles A. Huggett; Carl D. Farnsworth

[57] ABSTRACT

The fluid catalytic cracking of a residual oil fraction comprising metal contaminants and/or asphaltene type coke formers is processed by injecting the oil into the upper portion of a riser cracking operation under conditions to effect partial conversion thereof over a catalyst inactivated by carbonaceous deposits. A 650° F. plus product of the low sverity cracking is passed in contact with freshly regenerated catalyst under conditions of high conversion severity in the lower portion of the riser.

7 Claims, 5 Drawing Figures

Figure 1:
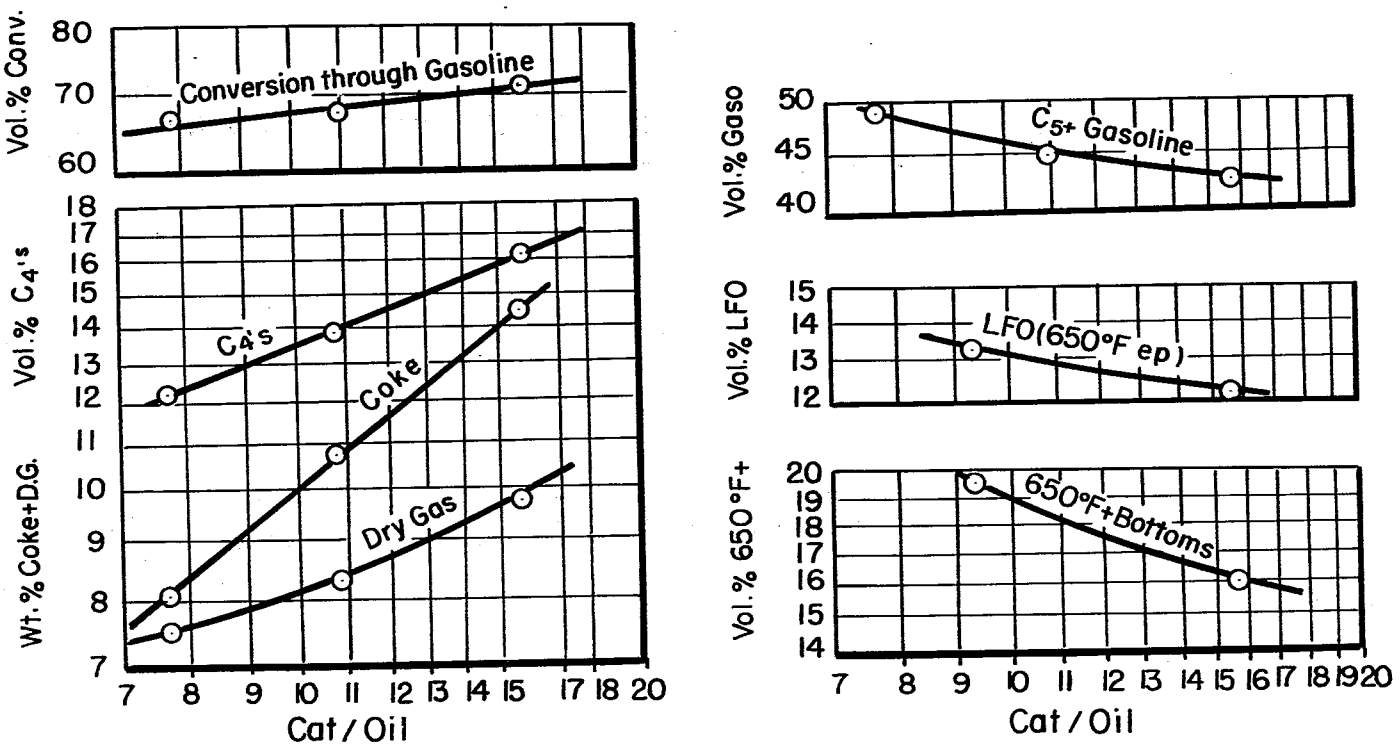

Yields on Second FCC Pass of 650°F+ Recycle from 50 Vol.% Conversion First Pass of Lt. Arab Atmospheric Resid Product Selectivity from Cracking Raw Lt. Arab Resid in Single Pass and in Recycle Operations Light Fuel Oil and 650°F Bottoms Yield from Cracking Raw Lt. Arab Resid in Single Pass and in Recycle Operation Single Pass and Recycle Runs with CHD Lt. Arab Atm. Charge
Product Selectivities

PROCESSING HYDROCARBON FEED OF HIGH CARBON RESIDUE AND HIGH METALS CONTENT

SUMMARY OF THE INVENTION

The invention is concerned with a method of processing high boiling residual oil of high Conradson carbon residue and also of high metals content. More particularly, the invention is concerned with processing a raw atmospheric resid boiling above 650° F. in a field catalytic cracking operation without subjecting the resid to vacuum distillation, hydrotreating or solvent deasphalting or other known techniques relied upon to remove metal components and carbon forming precursors.

In a particular aspect, the method of this invention takes advantage of the discovery that a low severity fluid catalyst cracking operation may be relied upon to remove substantially all of the undesired metal contaminants and substantial amounts of undesired additive coke molecules (including asphaltenes) from the high boiling residua feedstock by absorbing these components on a catalyst inactivated by coke or hydrocarbonaceous material. By a low severity cracking operation, it is intended to include those operations wherein conversion of the fresh hydrocarbon feed thereto is less than 50 volume percent to gasoline and lower boiling product components. Such a low severity conversion operation may be achieved by using a relatively spent cracking catalyst obtained from another cracking operation and coated with hydrocarbonaceous deposits and/or coke in combination with a very low contact time, less than 1 or 2 seconds, between hydrocarbon feed and catalyst, low temperatures and/or a combination of these operating conditions.

The removal of coke forming components such as asphaltenes and metal contaminants from the residua or raw atmospheric bottoms is accomplished according to this invention in a riser reactor fluid catalyst conversion operation under particularly selected low severity conditions. Although processing the hydrocarbon residua of atmospheric distillation boiling above 650° F. is a particular embodiment of this invention, it is also within the purview of the invention to subject the raw residua to relatively mild hydrotreating or solvent deasphalting operation thereof before effecting catalytic conversion thereof according to the method and concept of the invention.

In accordance with this invention, the process relies upon the discovery that a fluid catalyst cracking operation maintained under low severity processing conditions removes substantially all of the metals and substantial additive coke molecules from the feedstock by absorbing them on the coke and/or hydrocarbonaceous deposits on a used cracking catalyst. That is, the separated residua or fresh hydrocarbon feed material comprising atmospheric or raw residua of atmospheric distillation either before or after a mild hydrogenation pretreatment and containing greater than 3 ppm of nickel equivalents of metals and with a Conradson carbon level in excess of 5.0 weight percent is introduced into an upwardly flowing catalyst oil suspension in the upper portion of a riser fluid catalyst cracking operation so that the residua contacts a spent or deactivated catalyst comprising carbonaceous deposits for a period of time less than 2 seconds and, more usually, less than 1 second before effecting an initial separation of vaporous material from suspended catalyst particles in a separation zone provided. Generally speaking, the residence time of residua in contact with the suspended catalyst deactivated with carbonaceous deposits is less than one third of the residence time of the residua were introduced at the bottom of the riser conversion zone.

In performing the operation of this invention, it is preferred that the residua be at a temperature within the range of 200 to 700° F. or at the temperature recovered from an atmospheric distillation zone before being mixed with the suspension of spent catalyst and products of hydrocarbon conversion in the upper portion of the riser conversion. The spent catalyst suspension temperature may vary considerably and usually is at a temperature within the range of 900° F. to about 1050° F. depending on the severity of the cracking operation being effected with fresh catalyst introduced to the bottom of the riser. In the combination operation of this invention, it is preferred that the suspension in the upper portion of the riser be at a temperature below about 1000° F. so that the combination of temperature, time of contact and catalyst activity or severity of contact will restrict conversion of the residua introduced thereto to less than 50 volume percent gasoline and lower boiling products. In this regard, it is preferred that conversion of the residua be limited to effect primarily metals removal and additive carbon so that a better feed may be processed over freshly regenerated catalyst. Conversion levels in the range of 20 to 40 volume percent are particularly desired for this purpose.

The product of the riser cracking operation particularly comprising gases, naphtha, light fuel oil and higher boiling hydrocarbons is separated in a product fractionator. Restricting the cracking of the introduced residua to less than 50 volume percent of gasoline and lighter products permits the recovery of a more suitable 650° F. plus recycle stock from the product fractionator for use as charge passed in contact with freshly regenerated catalyst and forming the suspension contact downstream by raw residua. The recovered 650° F. plus material from the fractionator will comprise at least 35 volume percent of the raw residua or more depending on the severity of contact with the spent catalyst. This recovered 650° F. plus fraction of low metals content and reduced carbon forming components is charged to the bottom of the riser cracking zone for contact with clean-burned freshly regenerated catalyst at a temperature within the range of 1100° F. to 1500° F. and, more usually, restricted to a temperature within the range of 1200 to about 1350° F.

The 650° F. plus fraction cleaned of undesired components as above described forms a suspension with the cleanburned, active catalyst to form a suspension at an elevated cracking temperature in excess of about 950° F. but, more usually, at least about 1000° F. which is thereafter passed through the riser cracking zone for a hydrocarbon residence time sufficient to obtain a high level of conversion to gasoline and lower boiling hydrocarbon constituents in the range of 60 to 80 volume percent. The residence time of the 650° F. plus feed in the riser may be as high as 10 or 15 seconds depending on the temperature employed but, more usually, its residence time is less than 10 seconds and is in the range of 4 to 8 seconds. The higher the temperature of the formed suspension, the lower will be the residence time of the 650° F. plus feed and its products of conversion in the riser. The products of cracking the cleaned 650° F. plus feed and the products of the residua feed contact step in the upper portion of the riser are both separated from suspended catalyst and passed to the product fractionation step above briefly discussed, thus, completing the cycle of hydrocarbon feeds charged to the cracking operation.

An advantage of the present operation over one charging the residua and recycle 650° F. plus product to the bottom of a riser conversion operation is that the most easily cracked components of the residua feed are cracked at a low severity condition which leads to high gasoline and light fuel oil selectivities by minimizing overcracking of gasoline and light fuel oil components. A general belief that a coked catalyst imparts poorer gasoline selectivity than a clean-burned more active catalyst has been found to be true, particularly at high conversion levels where secondary cracking is more likely to be encountered. Low conversions of the more easily cracked components of the feedstock also contributes to a higher octane number in the gasoline product than does a high conversion level because the additional hydrogen transfer reaction occurring at high conversions saturates the formed olefins of the cracking operation. Olefins are known to be of a higher octane number than their saturated counterpart.

On the other hand, cracking of the catalyst stock reduced in metal and coke forming contaminants over the cleanburned or freshly regenerated catalyst obtained from an adjacent regeneration operation allows the most refractory components of the cleaned 650° F. plus feedstock to be cracked under high severity conditions without subjecting the less refractory components of the original residua feed to severe over-cracking conditions. Thus, gasoline selectivity from cracking the more refractory feed component comprising the cleaned 650° F. plus material is highest when low coke formation occurs in the catalyst and when metal components in the feed and on the catalyst are low.

It is not intended that the method and concepts of this invention be restricted to processing only raw residua since the invention is applicable to various relatively high boiling feed source containing metal and/or high carbon producing materials. For example, it is contemplated processing whole crude material with and without gasoline boiling range components, hydrocarbon products recovered from oil shale and tar sands as well as products of coal solvation desired to be converted to gasoline boiling range products and light fuel oils.

The process combination of this invention is effected in the presence of known cracking catalyst comprising amorphous silica-alumina cracking catalysts, crystalline aluminosilicate cracking catalyst known as crystalline zeolites and combinations thereof. The cracking catalyst may be a faujasite type or crystalline zeolite, mordenite and combinations thereof. In addition, the large pore crystalline zeolite such as faujasite and mordenite may be used in conjunction with a smaller pore crystalline zeolite such as provided by erionite, effertite, ZSM-5, ZSM-11, ZSM-12, ZSM-35 and ZSM-38. Thus, the processing concepts of this invention may be used with substantially any known or a combination of known cracking catalysts with advantage.

The cracking catalyst or combination of catalysts used to process a high coke producing hydrocarbon charge and which may or may not contain metal contaminants following the concepts of this invention are recovered from the hydrocarbon conversion operation, such as a riser conversion zone herein discussed and passed to a catalyst stripping zone wherein volatile components including entrained hydrocarbon vapors are separated from the catalyst with a stripping gas at a relatively high temperature. The stripping gas may be substantially any available inert gas to the operation such as steam, nitrogen, flue gas or $C_4$- gaseous hydrocarbons.

The stripped catalyst is then passed to catalyst regeneration wherein carbonaceous deposits remaining on the catalyst following the hydrocarbon conversion operation and the stripping operation are removed by burning in the presence of oxygen containing gases. During this burning operation, the activity of the catalyst is substantially restored and the catalyst is heated to an elevated temperature in the range of 1200 to 1600° F. and, more usually, within the range of 1250 to 1400° F. The technology of catalyst regeneration has been improved in recent years following the development of the crystalline zeolite conversion or crackng catalysts. The catalyst may be regenerated in a riser regeneration zone, in a dense fluid bed catalyst regeneration zone or a combination of the dense fluid bed and riser regeneration operation as provided by U.S. Pat. No. 3,926,778, issued Dec. 16, 1975.

DISCUSSION OF SPECIFIC EMBODIMENTS

The processing concepts of the invention were tested and evaluated using two different feedstocks: one a raw atmospheric resid boiling above about 650° F., and a mildly hydrotreated resid boiling above about 650° F. The evaluation was completed using a low activity coked catalyst to initially contact the feedstock and, thus, simulating effecting the contact of the catalyst in the upper portion of a riser conversion zone. After distilling off a gasoline and a light fuel oil product fraction, the 650° F. plus bottom fraction separated from metal contaminants and high coke producing components was injected in the bottom of a riser in contact with clean-burned catalyst at a high temperature to simulate the recycle of cleaned feed as herein provided.

EXAMPLE 1

The feedstock is a raw Arab light atmospheric resid. The compositions of it and of the 650° F. plus fractionator bottoms after the initial pass at low conversion over a deactivated catalyst are given in Table 1. The low conversion pass has removed over 99% of the metals and about 96% of the Conradson carbon and asphaltenes.

Table 1

Composition and Properties of Feedstock And Recycle for Example 1

| | | Fresh Feed | 650° + Recycle |
|---|---|---|---|
| Vol. % of Fresh Feed | | 100 | 34.3 |
| API | | 17.9 | 15.6 |
| Wt. % | Hydrogen | 11.5 | 10.6 |
| " | Sulfur | 2.9 | 3.5 |
| " | Nitrogen | 0.1 | — |
| " | Nickel | 5.6 | <0.05 |
| " | Vanadium | 26.0 | 0.20 |
| | CCR | 6.4 | 0.69 |
| | Asphaltenes | 4.3 | 0.34 |
| | $C_A$ | 25 | 66 |
| Molecular Weight | | 515 | 363 |
| Distillation: | IBP | 619 | 617 |
| (TBP) | 1 Wt. % | 641 | 634 |
| | 5 | 676 | 657 |
| | 10 | 701 | 675 |
| | 20 | 747 | 699 |
| | 30 | 798 | 722 |
| | 40 | 845 | 744 |
| | 50 | 901 | 770 |
| | 60 | 957 | 799 |

Table 1-continued

| Composition and Properties of Feedstock And Recycle for Example 1 | | |
|---|---|---|
| | Fresh Feed | 650° + Recycle |
| 65 | 1089 | 815 |
| 70 | — | 836 |
| 80 | — | 885 |
| 90 | — | 961 |

Riser cracking data are given in Table 2 for the raw resid in single pass high conversion riser cracking operation as well as for the low conversion initial pass conversion prior to effecting the high conversion of 650° F. plus bottoms according to the process. The high activity catalyst used in both the high conversion operation and in cracking the 650° F. plus recycle is an equilibrium commercial cracking catalyst with an activity of about 61 FAI. The deactivated catalyst is the same catalyst containing 1.26% C obtained from previous runs, stripped but not regenerated and having an activity of 43 FAI. The combined yields from a low conversion initial pass of raw resid to remove contaminants and a high severity recycle conversion are also shown in Table 2.

Table 2

Separate Riser and Combined Riser Yields for Raw Resid

| Charge Stock | Raw Arab Lt. Atm. Resid (74D-4021) | | | | | 650° + Bottoms from 180H-74 | | | Raw Arab Lt. Atm. Resid (74D-4021) | | |
|---|---|---|---|---|---|---|---|---|---|---|---|
| Catalyst | Clean-burned Eq. 75F. | | | Spent Eq. 75F. (1.25% C.) | | Clean burned Eq. 75F. | | | Combined risers for new process | | |
| Catalyst Res./ Time, Sec. | ← | 2.0 | → | 0.75 | 0.75 | ← | 2.7 | → | | | |
| Cat/Oil Wt. Ratio | 4.27 | 5.18 | 8.00 | 5.65 | 5.51 | 7.72 | 10.88 | 15.51 | | | |
| Oil Partial Pressure (psia) | 14.0 | 14.3 | 12.5 | 15.3 | 15.4 | 15.6 | 15.6 | 12.6 | | | |
| $T_{mix}$ | 995 | 984 | 999 | 976 | 978 | 996 | 1002 | 1000 | | | |
| Conversion of Charge | | | | | | | | | | | |
| Vol. % Conv. thru Gaso. | 55.31 | 63.97 | 70.33 | 50.41 | 47.73 | 66.63 | 67.54 | 72.67 | 72.91 | 73.28 | 75.33 |
| " $C_5$+ Gaso. | 45.52 | 53.63 | 55.94 | 43.54 | 40.64 | 48.76 | 44.84 | 44.97 | 60.26 | 58.92 | 58.96 |
| " $C_4$'s | 9.10 | 8.41 | 9.79 | 7.38 | 7.21 | 12.21 | 13.90 | 15.19 | 11.57 | 12.15 | 12.83 |
| Wt. % Dry Gas | 4.48 | 5.81 | 7.19 | 4.00 | 3.79 | 7.48 | 8.32 | 9.81 | 6.56 | 6.85 | 7.36 |
| " Coke | 6.70 | 7.63 | 9.19 | 5.92 | 6.11 | 8.07 | 10.74 | 14.34 | 8.69 | 9.60 | 10.82 |
| Vol. % LFO (650° cp) | 16.46 | 15.56 | 14.98 | 15.25 | 16.19 | 13.40 | 13.04 | 12.02 | 19.85 | 19.72 | 19.37 |
| " 650° + Bottoms | 28.23 | 20.46 | 14.69 | 34.33 | 36.08 | 19.97 | 19.43 | 15.31 | 6.85 | 6.66 | 5.27 |
| Properties of Products | | | | | | | | | | | |
| $C_5$ + Gaso. O.N. (R + O) | 87.2 | 88.1 | 89.2 | 88.8 | 88.7 | 89.8 | 89.9 | 89.7 | 89.1 | 89.1 | 89.0 |
| LFO ° API | 18.2 | 16.3 | 13.1 | 20.3 | — | 5.4 | 5.4 | 2.6 | 16.6 | 16.7 | 16.2 |
| Wt. % Hydrogen | 9.90 | 9.57 | 8.98 | 10.32 | — | 7.86 | 7.86 | 7.16 | 9.75 | 9.70 | 9.65 |
| Wt. % Aromatics | 71.7 | 76.3 | 82.5 | 66.7 | — | | | | | | |
| Run No. | 180H | → | → | → | → | 220 | 220 | 220 | 180H74 | → | → |
| | 80 | 79 | 78 | 74 | 76 | 135 | 136 | 137 | 220-135 | 220-136 | 220-137 |
| Date of Run, 1976 | 7/1 | 6/30 | 6/29 | 6/17 | 6/18 | 11/4 | 11/8 | 11/9 | | | |

Figure 2:
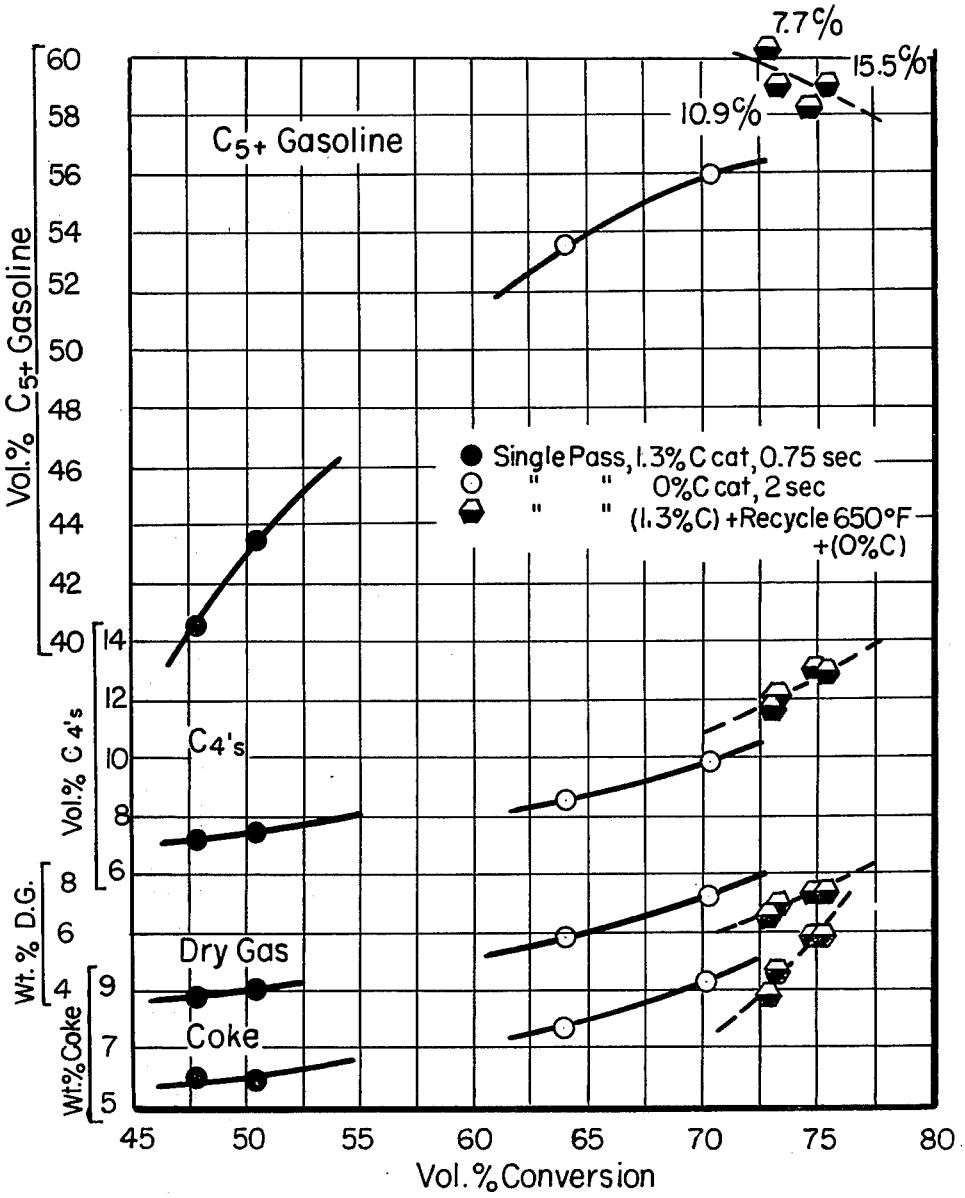

The yield data for the 650° F. plus recycle over a clean-burned catalyst are plotted in FIG. 2. These curves show that high cat/oil ratios are to be avoided because of a linear dependency of catalytic coke make with cat/oil ratio. Conversion to coke decreases the yield of gasoline and light fuel oil.

Figure 3:
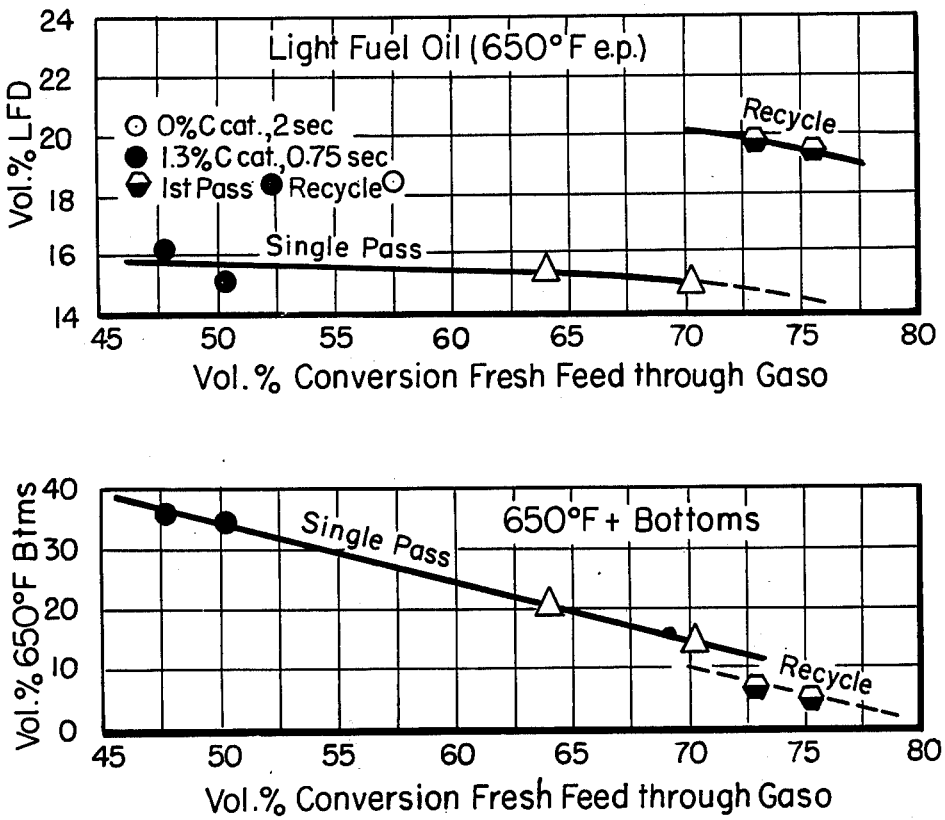
Figure 4:
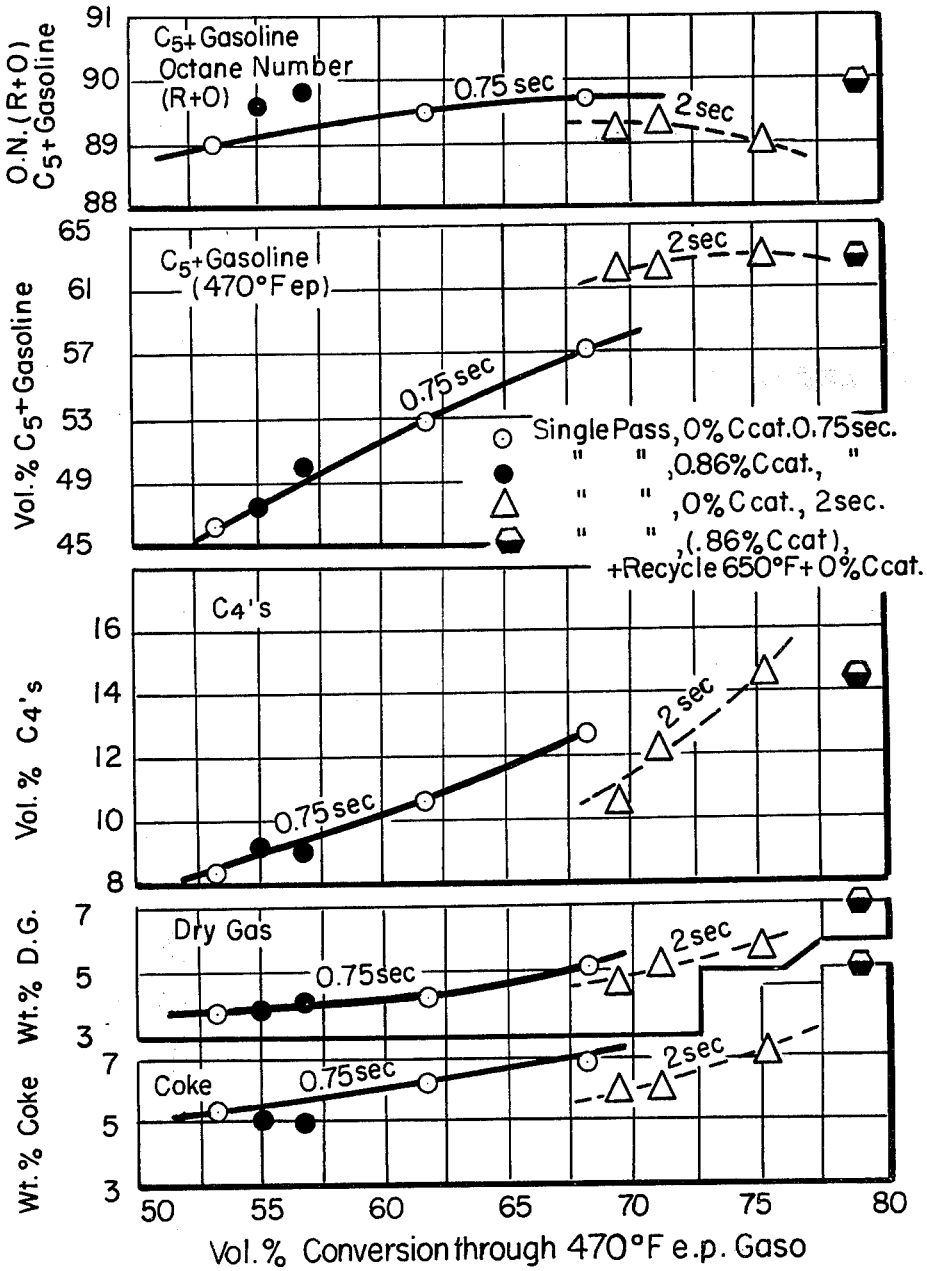

The yield data for the single pass runs are compared in FIG. 3 to the combined yield for the combination operation of the present invention. Gasoline yield advantages of 2.5 to 3.5 vol. % are obtained for the new process of this invention. FIG. 4 indicates a yield advantage of 4.5 vol. % light fuel oil. At the conditions used in these three cases (recycle cracking at 7.7, 10.9, and 15.5 cat/oil), the amount of 650° F. plus bottoms from one pass of recycle cracking is only 4 to 7 vol. % of fresh feed.

As shown in Table 2, the gasoline octane in a combined riser run is identical (within reproducibility of ± 0.3 ON) to a single high conversion cracking run but the light fuel oil has a considerably higher hydrogen content (higher gravity and lower aromatic concentration) which gives it higher quality.

EXAMPLE 2

The feedstock is a mildly hydrotreated Arab light atmospheric resid. The composition of it and of the 650° F. plus fractionator bottom after the initial pass at low conversion over a deactivated catalyst are given in Table 3. The low conversion pass has removed 99% of the metals and 97% of the Conradson carbon (94% of the asphaltene).

Table 3

| Composition and Properties of Feedstock and Recycle for Example 2 | | | |
|---|---|---|---|
| | | Fresh Feed | 650° + Recycle |
| Vol. % of Fresh Feed | | 100 | 29.5 |
| API | | 21.5 | 18.6 |
| Wt. % | Hydrogen | 12.1 | 10.1 |
| " | Sulfur | 1.0 | 1.5 |
| " | Nitrogen | 0.16 | 0.13 |
| " | Nickel | 2.1 | <0.05 |
| " | Vanadium | 2.2 | <0.05 |
| | CCR | 5.2 | 0.59 |
| | Ashpaltenes | 1.9 | 0.41 |
| | $C_A$ | 19 | 33 |
| Molecular Weight | | 515 | 357 |
| Distillation: (TBP) | IBP | 635 | 641 |
| | 1 Wt. % | 649 | 650 |
| | 5 | 674 | 667 |
| | 10 | 700 | 681 |
| | 20 | 746 | 704 |
| | 30 | 785 | 725 |
| | 40 | 831 | 748 |
| | 50 | 889 | 771 |
| | 60 | 954 | 801 |
| | 65 | 1000 | 817 |
| | 70 | — | 835 |
| | 80 | — | 887 |
| | 90 | — | 953 |

Riser cracking data are given in Table 4 for this charge stock in single pass high conversion runs and for low conversion runs with short residence time of deactivated catalyst as well as a comparison with short residence time with high activity catalyst. The 650° F. plus recycle conversion data are also given at one cat/oil ratio. The high activity catalyst is the same 61 FAI commercial catalyst used in Example 1 while the deactivated catalyst is the same catalyst containing 0.86% C from a previous run and having a 49 FAI activity.

Table 4

Separate Riser and Combined Riser Yields for Hydrotreated Resid

| Charge Stock | CHD Arab. Light Atmospheric Resid (135-790) | | | | | | | | 650° + Bottoms from 180H-70 | CHD Arab Lt. Atm. Resid (135-790) |
|---|---|---|---|---|---|---|---|---|---|---|
| Catalyst | Clean-burned Equil. 75F | | | Clean-burned Equil. 75F | | | Spent Equil. 75F (0.86% C.) | | Clean-burned Eq. 75F | |
| Cat. Res. Time, Sec. | ← | 1.8 | → | 0.75 | 0.75 | 0.75 | 0.75 | 0.75 | ←3.3→ | 180H-70 |
| Cat/Oil Wt. Ratio | 4.51 | 4.61 | 6.65 | 4.00 | 5.92 | 8.26 | 6.07 | 5.98 | 19.66 | 220-141 |
| O.P.P. (psia) | 14.1 | 13.9 | 13.7 | 14.2 | 13.9 | 13.8 | 14.1 | 14.4 | 14.3 | for new |
| $T_{mix}$ | 1002 | 1005 | 1001 | 1002 | 1001 | 1001 | 1000 | 1001 | 999 | process |
| Conversion of Charge | | | | | | | | | | |
| Vol. % Conv. thru Gaso. | 69.39 | 71.09 | 75.12 | 53.14 | 61.74 | 68.16 | 54.91 | 56.74 | 75.47 | 79.00 |
| $C_5$ + Gaso., vol. % | 62.23 | 62.31 | 63.19 | 46.53 | 52.90 | 57.21 | 45.81 | 50.01 | 43.20 | 62.75 |
| $C_4$'s " | 10.39 | 12.22 | 14.57 | 8.41 | 10.61 | 12.79 | 9.26 | 9.16 | 17.65 | 14.40 |
| Wt. % Dry Gas | 4.59 | 5.29 | 5.64 | 3.73 | 4.24 | 5.18 | 3.80 | 4.09 | 10.27 | 7.12 |
| "Coke | 5.86 | 5.89 | 7.01 | 5.41 | 6.27 | 6.82 | 5.16 | 5.01 | 16.03 | 9.74 |
| Vol. % LFO (650° cp) | 14.86 | 15.57 | 14.73 | 14.14 | 13.52 | 13.55 | 14.19 | 13.72 | 10.84 | 16.92 |
| Vol. % 650° + Bottoms | 15.76 | 13.33 | 10.15 | 32.72 | 24.74 | 18.29 | 30.90 | 29.53 | 13.69 | 4.04 |
| Properties of Products | | | | | | | | | | |
| $C_5$+ Gaso. O.N. (R + O) | 89.2 | 89.3 | 89.0 | 89.0 | 89.5 | 89.7 | 89.6 | 89.8 | 90.4 | 89.9 |
| LFO API | 20.0 | — | 15.9 | 22.7 | 20.9 | 19.4 | 22.6 | | 4.8 | 18.9 |
| Wt. % Hydrogen | 10.01 | — | 8.89 | 10.57 | 10.15 | 10.02 | 10.50 | | 7.39 | 9.91 |
| Wt. % Aromatics | 74.3 | — | 81.0 | 66.8 | 70.7 | 75.1 | 67.4 | | | |
| Run No. | 180H 36 | 180H 34 | 180H 35 | 180H 65 | 180H 66 | 180H 67 | 180H 68 | 180H 70 | 220-141 | 180H-70+ 220-141 |
| Date of run, 1976 | 3/18 | 3/16 | 3/17 | 5/27 | 5/28 | 6/1 | 6/2 | 6/3 | 11/17 | |

Figure 5:
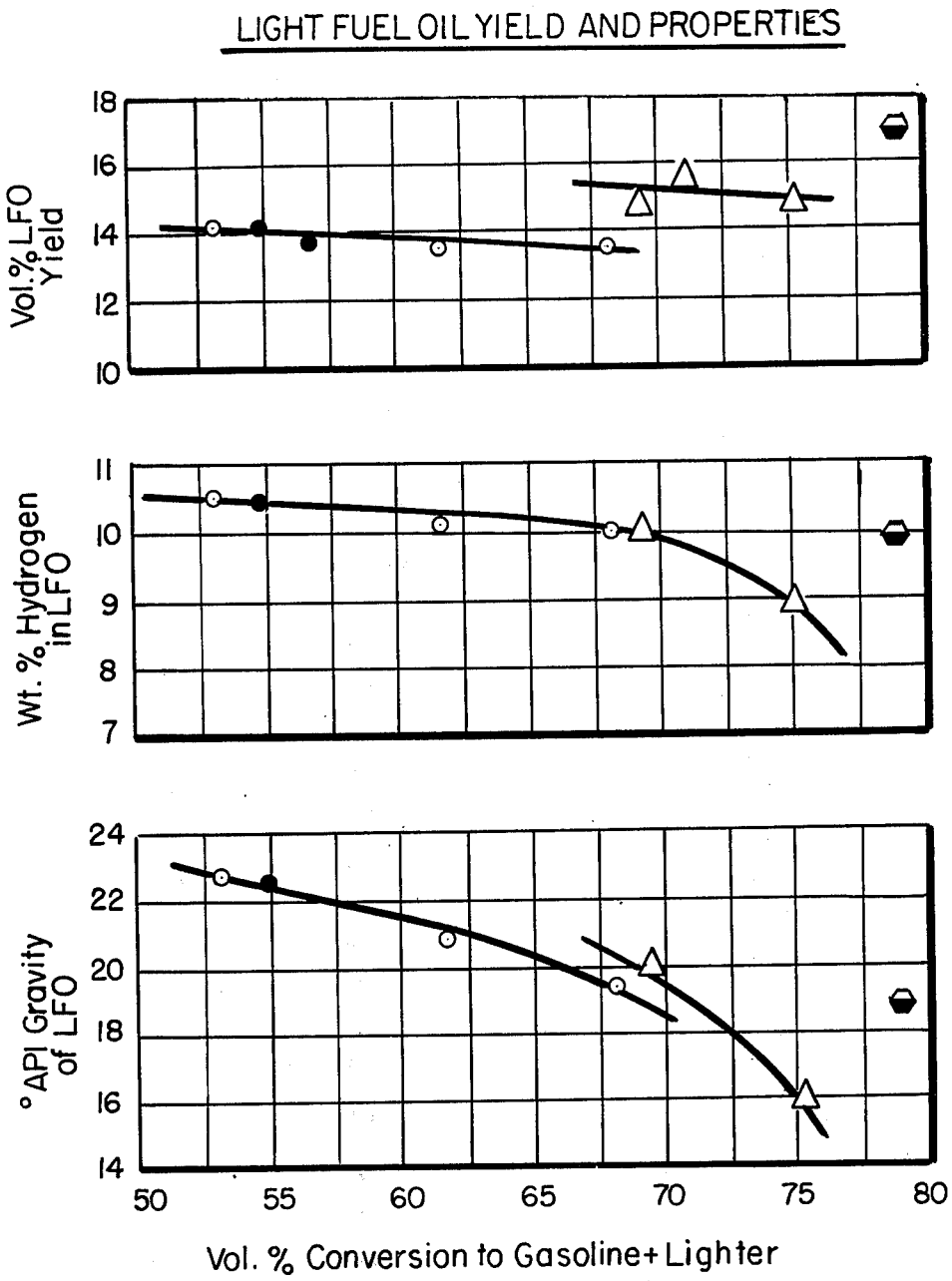

These data are plotted in FIG. 5. The deactivated catalyst contributes no loss to gasoline selectivity over the clean-burned high activity catalyst at low conversion levels. A higher octane number is contributed to the gasoline by the coked catalyst at short contact time. The combined yield from the two pass process is essentially equal to that from the conventional one riser process; however, the gasoline octane number is about 1½ units higher. A very high cat/oil ratio used for recycle cracking has contributed to a high coke make in this step. Reducing catalyst circulation in the single riser will reduce cat/oil ratio and increase gasoline yield, as was shown in Example 1. The light fuel oil yield is shown in FIG. 6 to be about 2 vol. % higher than that made in a single pass high conversion step, and its composition is more saturated (higher hydrogen content and lower °API).

Catalytic cracking of resid stock heretofore has seen limited application because gasoline yields are reduced due to high coke and gas make. Making cracking of resid stock of interest had led refiners to treat the feedstock to remove the contaminants (hydrotreating or solvent deasphalting). These methods involve costly pressure units or expensive chemical treatment. The present concept allows atmospheric resid to be catalytically cracked at high selectivity without a pretreating step.

It will be recognized by those skilled in the art that the method and sequence of contact steps of this invention are available for use in many different arrangements of contact zones. For example, it is not essential that one use a single riser contact zone even though such may be the most efficient arrangement for the combination desired. The sequential operation may be effected in separate contact zones or vessel arrangements provided with a common regeneration zone.

Having thus generally described the invention and provided specific examples in support thereof, it is to be understood that no undue restrictions are to be imposed by reason thereof.

I claim:

1. A method for converting a high boiling hydrocarbon residua comprising greater than 3 ppm of nickel equivalent of metals and coke forming asphaltenes to produce lower boiling more desirable components which comprises, contacting said high boiling hydrocarbon residua comprising metal contaminants with a coke deactivated catalyst for a period of time less than 2 seconds at a temperature restricting conversion of the residua to gasoline and lower boiling components within the range of 20 to 40 volume percent, separating a product of said residua conversion operation to recover material higher boiling than gasoline and including a 650° F. plus recycle fraction substantially free of metals, and converting the recovered 650° F. plus recycle fraction freed of metals in the presence of freshly regenerated catalyst at a temperature in excess of 950° F. whereby a high level of conversion to gasoline and lower boiling hydrocarbon constituents in the range of 60 to 80 volume percent is obtained thereby providing a coke deactivated catalyst thereafter used to effect conversion of said hydrocarbon residua as above recited.

2. The method of claim 1 wherein the high boiling hydrcarbon residua is selected from a group of feed materials consisting of raw crude residua, a 650° F. plus fraction obtained from a crude oil atmospheric distillation operation, a hydrocarbon product of oil shale or tar sands, and a wide cut boiling range portion of crude oil.

3. The method of claim 1 wherein the metal containing residua is a 650° F. plus fraction obtained from a crude oil atmospheric distillation operation.

4. The method of claim 1 wherein the cracking operation is accomplished in a single riser cracking zone wherein the hydrocarbon residua comprising metal contaminants is charged to an upflowing suspension of catalyst and hydrocarbon products of converting the recycle fraction freed of metals.

5. The method of claim 1 wherein the low severity cracking step is effected under conditions restricting conversion of the feed to gasoline and lower boiling hydrocarbons to less than 30 volume percent and conversion of the higher boiling hydrocarbon fraction obtained therefrom is at least 60 volume percent.

6. The method of claim 1 wherein the separate cracking operations are effected in sequence and the catalyst is regenerated to remove carbonaceous deposits by burning before recycle to the sequential cracking operation.

7. The method of claim 1 wherein the separate cracking operations are accomplished in separate cracking zones.

* * * * *

UNITED STATES PATENT AND TRADEMARK OFFICE

CERTIFICATE OF CORRECTION

PATENT NO. : 4,147,617

DATED : April 3, 1979

INVENTOR(S) : Donald M. Nace

It is certified that error appears in the above-identified patent and that said Letters Patent are hereby corrected as shown below:

| | |
|---|---|
| Abstract, line 7 | "sverity" should be —severity-- |
| Column 1, line 9 | "field" should be --fluid-- |
| Column 1, line 31 | delete dash after "and" |
| Column 2, line 4 | "of" (second occurrence) should be -- if -- |
| Column 3, line 24 | "catalyst" should be —recycle-- |
| Table 1, line 1 | "and" should be —And-- |
| Table 4, line 25 | "LFO API" should be --LFO ° API— |
| Table 4, last col., line 12 | "180H-70" should be --: 180-70 and -- |
| Column 8, line 41 | "residua" should be —residue-- |

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*